US009539467B2

(12) United States Patent
Hashish

(10) Patent No.: US 9,539,467 B2
(45) **Date of Patent: *Jan. 10, 2017**

(54) EXERCISE SYSTEM FOR SHIFTING AN OPTIMUM LENGTH OF PEAK MUSCLE TENSION

(71) Applicant: Rami Hashish, Long Beach, CA (US)

(72) Inventor: Rami Hashish, Long Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/944,939

(22) Filed: Nov. 18, 2015

(65) Prior Publication Data

US 2016/0067549 A1 Mar. 10, 2016

Related U.S. Application Data

(63) Continuation of application No. 13/897,618, filed on May 20, 2013, now Pat. No. 9,339,692, and a (Continued)

(51) Int. Cl.
*A63B 24/00* (2006.01)
*A63B 21/045* (2006.01)
(Continued)

(52) U.S. Cl.
CPC ..... *A63B 24/0087* (2013.01); *A63B 21/008* (2013.01); *A63B 21/0058* (2013.01);
(Continued)

(58) Field of Classification Search
CPC ..... A63B 24/0087; A63B 2024/0093; A63B 21/00181; A63B 21/0058; A63B 21/008; A63B 21/045; A63B 21/0552; A63B 21/06; A63B 21/0724; A63B 21/0726; A63B 2023/0411; A63B 2220/10; A63B 2220/40; A63B 2220/51; A63B 2220/803; A63B 2220/808; A63B 2225/20
See application file for complete search history.

(56) References Cited

U.S. PATENT DOCUMENTS 4,540,171 A 9/1985 Clark et al.
4,765,610 A 8/1988 Sidwell
(Continued)

OTHER PUBLICATIONS

Matt Brughelli and John Cronin, altering the length-tension relationship with Eccentric Exercise: implications for performance and injury, 2007,007-020, Sports Med. 2007.037(s), School of Exercise, Biomedical and Health Sciences, Edith Cowan University, Joondalup, Western Australia, Australia.
(Continued)

*Primary Examiner* — Sundhara Ganesan
(74) *Attorney, Agent, or Firm* — Ruttler Mills, PLLC; James J. Ruttler

(57) ABSTRACT

The present disclosure relates generally to exercise equipment for enabling a user to vary the effective muscle tension during the course of the performance of an exercise and, more particularly, to an exercise system for shifting an optimum length of peak muscle tension. In some embodiments, the system is an apparatus which comprises a force-generating element, e.g. a fluid cylinder, a user-input element which a user forcibly moves during the course of performance of an exercise, and also a coupling means, which is preferably a cable-pulley system, which transfers forces between the force-generating element and the user-input element. Finally, the apparatus comprises a control unit which controls and varies the level of force generated by the force-generating element during the course of performance of the exercise. The apparatus effectively varies the effective muscle tension through the generation of forces.

20 Claims, 9 Drawing Sheets

Related U.S. Application Data continuation-in-part of application No. PCT/US2014/036047, filed on Apr. 30, 2014.

(51) Int. Cl.

| | |
|---|---|
| ***A63B 21/06*** | (2006.01) |
| ***A63B 21/005*** | (2006.01) |
| ***A63B 21/08*** | (2006.01) |
| ***A63B 21/055*** | (2006.01) |
| ***A63B 21/00*** | (2006.01) |
| ***A63B 21/072*** | (2006.01) |
| ***A63B 21/008*** | (2006.01) |
| *A63B 23/04* | (2006.01) |

(52) U.S. Cl.

CPC ..... *A63B 21/00181* (2013.01); *A63B 21/045* (2013.01); *A63B 21/0552* (2013.01); *A63B 21/06* (2013.01); *A63B 21/0724* (2013.01); *A63B 21/0726* (2013.01); *A63B 2023/0411* (2013.01); *A63B 2024/0093* (2013.01); *A63B 2220/10* (2013.01); *A63B 2220/40* (2013.01); *A63B 2220/51* (2013.01); *A63B 2220/803* (2013.01); *A63B 2220/808* (2013.01); *A63B 2225/20* (2013.01)

(56) References Cited

U.S. PATENT DOCUMENTS

| | | | | |
|---|---|---|---|---|
| 4,919,418 | A * | 4/1990 | Miller | A63B 21/151 482/112 |
| 5,011,142 | A | 4/1991 | Eckler | |
| 5,178,160 | A | 1/1993 | Gracovetsky et al. | |
| 5,254,066 | A * | 10/1993 | Brown | A63B 21/154 482/113 |
| 5,364,326 | A * | 11/1994 | Smith | A63B 21/00072 482/113 |
| 5,397,287 | A | 3/1995 | Lindfors | |
| 5,569,120 | A | 10/1996 | Anjanappa et al. | |
| 5,762,584 | A | 6/1998 | Daniels | |
| 5,827,154 | A | 10/1998 | Gill | |
| 5,919,115 | A | 7/1999 | Horowitz | |
| 7,651,442 | B2 | 1/2010 | Carlson | |
| 8,388,499 | B1 | 3/2013 | Rindfleisch | |
| 2003/0069108 | A1 | 4/2003 | Kaiserman | |
| 2005/0119591 | A1 | 6/2005 | Vardy | |
| 2005/0239612 | A1 * | 10/2005 | Keiser | A63B 21/0087 482/94 |
| 2006/0264299 | A1 | 11/2006 | Farinelli et al. | |
| 2008/0058164 | A1 * | 3/2008 | Douglas | A63B 21/0087 482/5 |
| 2010/0069202 | A1 | 3/2010 | Olsen | |
| 2010/0216600 | A1 | 8/2010 | Noffsinger et al. | |
| 2011/0082006 | A1 | 4/2011 | Ishii et al. | |
| 2011/0275480 | A1 | 11/2011 | Champsaur | |
| 2012/0142497 | A1 | 6/2012 | Ishii et al. | |
| 2012/0329615 | A1 | 12/2012 | Jeong | |
| 2013/0012359 | A1 | 1/2013 | Hanoun | |

OTHER PUBLICATIONS

N.P. Whitehead, N.S. Weerakkody, J.E. Gregory, D.L. Morgan & U. Proske. Changes in passive tension of muscle in humans and animals after eccentric exercise, Journal of Physiology (2001), 533.2 pp. 593,604, Department of Physiology and *Department of Electrical and Computer Systems Engineering, Monash University, Clayton, Victoria 3168, Australia.

* cited by examiner

EXERCISE SYSTEM FOR SHIFTING AN OPTIMUM LENGTH OF PEAK MUSCLE TENSION

PRIORITY CLAIM

This application is a continuation of U.S. non-provisional patent application Ser. No. 13/897,618 filed May 20, 2013 and PCT patent application PCT/US14/36047 filed Apr. 30, 2014. Priority and/or benefit claim is made to the foregoing applications and any parent, grandparent, and great-grandparent applications thereof. The foregoing applications are incorporated by reference in their entirety as if fully set forth herein.

FIELD OF THE DISCLOSURE

The present disclosure relates generally to exercise equipment and, more particularly, to an exercise system for shifting an optimum length of peak muscle tension.

BACKGROUND

There is a growing interest in performing exercises designed to shift the optimum length of peak tension in muscles. The magnitude of force that a muscle is capable of generating depends, at least partially, on its length, velocity, and innervation. The optimum length of peak muscle tension (the "optimum length") refers to the length at which a muscle is capable of producing the highest level of tension. The optimum length of peak tension in muscles can be shifted to longer muscle lengths through emphasis on eccentric training. Furthermore, the emphasis on concentric exercise may foster the development of type II b fibers fast contracting muscle tissue. Eccentric exercise may refer to an exercise during which a muscle is simultaneously contracting and lengthening such that the muscle contraction resists the lengthening of the muscle. For example, during an eccentric contraction the force generated by the muscle is insufficient to overcome the external load on the muscle and, as a result, the muscle fibers lengthen. Eccentric contractions may be performed as a means of lowering a load gently rather than allowing it to drop. Concentric exercise may refer to an exercise during which a muscle is simultaneously contracting and shortening such that the muscle contraction causes the shortening of the muscle. For example, during a concentric contraction the force generated by the muscle is sufficient to overcome the external load on the muscle and, as a result, the muscle fibers shorten. Depending on the type of athletic activity intended to be subsequently performed, i.e. the specific sport or activity which an individual is exercising in preparation for, either concentric, eccentric, or even isometric exercises may be desired. Performing certain types of eccentric exercise as a means of positively affecting mechanical properties of muscle is of particular interest. After even a single session of eccentric exercise, the length-tension relationship of a muscle (or group of muscles) can be altered such that the highest level of tension is produced at a longer muscle length than prior to the exercise session. This phenomenon potentially has beneficial implications for the reduction of injury and increased athletic performance.

Regarding reduction of injury specifically, many researchers contend that athletes whom produce peak tension at shorter muscle lengths are more prone to injury. As an example, the biarticulate hamstring muscles have been studied in this regard due to the high prevalence of hamstring injuries in sports. During the late swing phase in running, the hamstring is actively stretched via the simultaneous actions of hip flexion and knee extension and, resultantly, the hamstring muscles experience high tensions at or near their greatest lengths. This makes the hamstrings highly susceptible to muscle strain injuries. However, the risk of such injuries can be reduced by shifting the optimum length of peak muscle tension such that the optimum length occurs at longer muscle lengths, and as previously discussed, such a result can be accomplished through eccentric exercises. Regarding improvement of athletic performance, researchers have contended that eccentric exercise results in greater passive muscle stiffness at longer lengths and that this increases potential force production before muscle failure.

Despite the known benefits of eccentric exercise, the availability of specialized equipment allowing for a single person to efficiently perform such exercises without the assistance of others is, so far as applicant is aware, under developed. In some situations eccentric exercises, e.g. heavy eccentric lifts, cannot be performed at all without multiple spotters. For example, the performance of heavy eccentric barbell squats is not apt for a single user to perform because a user may become "stuck" in the squatted position resulting in a heightened risk of injury.

Information relevant to attempts to address these problems can be found in the following: U.S. Pat. No. 8,388,499 B1 to Rindfleisch, dated Mar. 5, 2013, and fully incorporated by reference herein; U.S. Pat. No. 4,540,171 to Clark et al., dated Sep. 10, 1985, and fully incorporated by reference herein; and U.S. Pat. No. 5,397,287 to Lindfors, dated Mar. 14, 1995, and fully incorporated by reference herein.

For the foregoing reasons, there is a need for an exercise system for enabling a user to vary the effective muscle tension during the course of the performance of an exercise for shifting an optimum length of peak muscle tension. Accordingly, such an exercise system is disclosed herein.

SUMMARY

The present disclosure relates generally to exercise equipment for enabling a user to vary the effective muscle tension during the course of the performance of an exercise and, more particularly, to an exercise system for shifting an optimum length of peak muscle tension.

In some embodiments, the system is an apparatus which comprises a force-generating element, e.g. a fluid cylinder or a motor, a user-input element which a user forcibly moves during the course of performance of an exercise, and also a coupling means, which is preferably a cable-pulley system, which transfers forces between the force-generating element and the user-input element. Finally, the apparatus comprises a control unit which controls and varies the level of force generated by the force-generating element during the course of performance of the exercise. The apparatus effectively varies the effective muscle tension through the generation of forces.

In some embodiments, the system comprises at least one user-input element for movement by a user during a course of performance of an exercise, at least one force-generating element for generating at least one level of generated force, coupling means for interconnecting the at least one user-input element and the at least one force-generating element, and at least one control unit. The control unit may be configured to perform the operations of receiving at least one level of user-input force for causing movement of the at least one user-input element during the course of performance of an exercise by a user and varying at least one level of generated force during the course of performance of an exercise by a user.

An exemplary use of an embodiment, for example, is a user performing an exercise during which a user is assisted during the concentric contraction portion of an exercise but the assistance is withheld during the eccentric contraction portion of an exercise. For example, in using an embodiment of the apparatus a user may perform barbell squats wherein the total weight of the barbell is 200 pounds-mass (lb.) and wherein the control unit is configured to cause the force-generating element to provide 150 lb. supplementary force during only the concentric portion of the exercise. Therefore, the effective weight of the barbell is 200 lb. during the eccentric portion of the exercise and reduced to 50 lb. during the concentric portion of the exercise.

BRIEF DESCRIPTION OF THE DRAWINGS

These and other features, aspects, and advantages of the present disclosure will become better understood with regard to the following description, appended claims, and accompanying drawings where:

DETAILED DESCRIPTION

Figure 1:
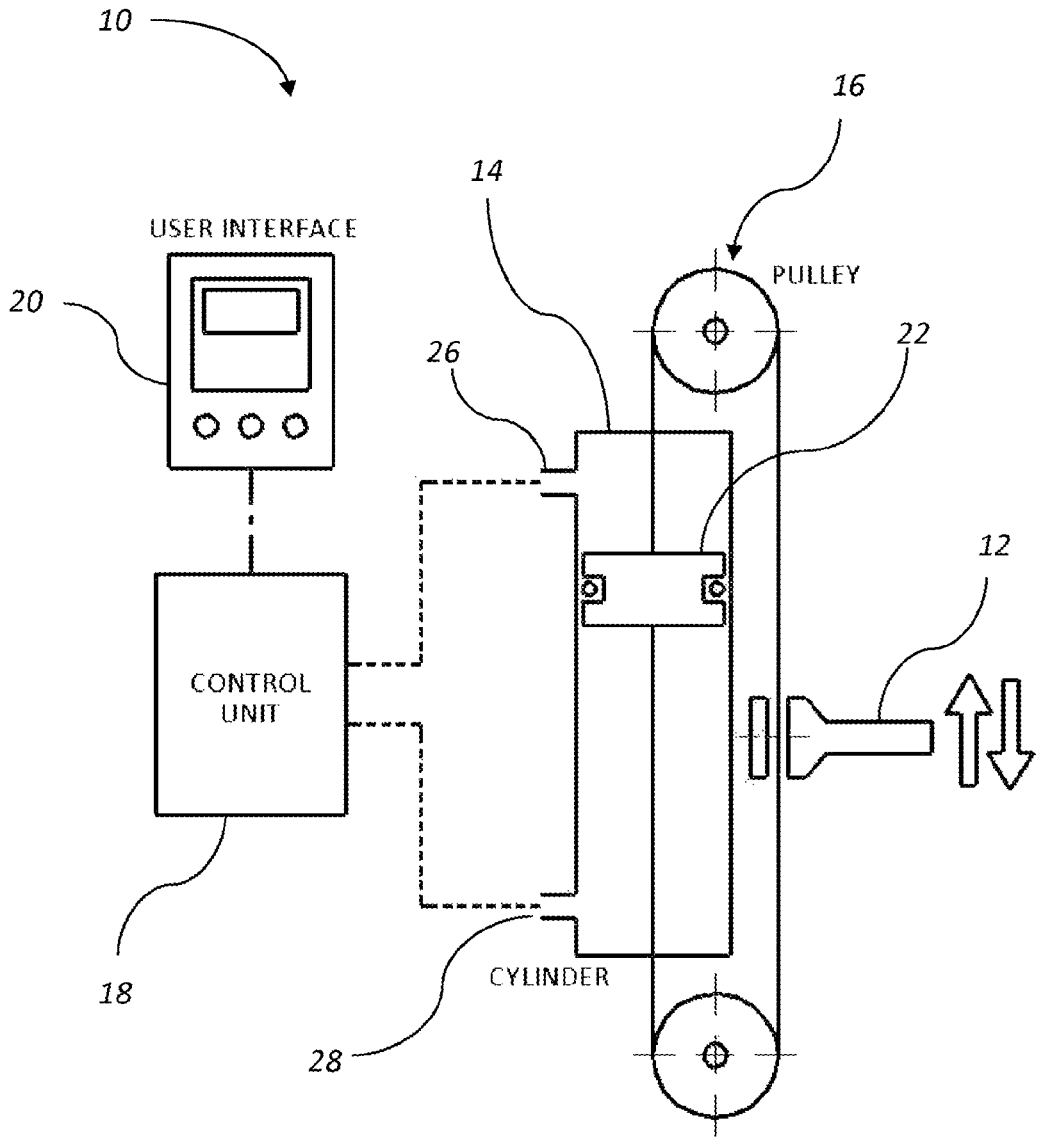
FIG. 1 shows a system diagram of the exercise system for shifting an optimum length of peak muscle tension in accordance with a first embodiment of the present disclosure.

The present disclosure relates generally to exercise equipment for enabling a user to vary the effective muscle tension during the course of the performance of an exercise and, more particularly, to an exercise system for shifting an optimum length of peak muscle tension. Specific details of certain embodiments of the apparatus and system are set forth in the following description and FIGS. 1-9 to provide a thorough understanding of such embodiments. The present invention may have additional embodiments, may be practiced without one or more of the details described for any particular described embodiment, or may have any detail described for one particular embodiment practiced with any other detail described for another embodiment. For example, a motor, instead of a cylinder could be used to generate torque which in turn generates a force to be transmitted via the cable/pulley mechanism to the user input element.

As used herein, the term "jerk" is the rate of change of acceleration; i.e. the derivative of acceleration with respect to time, the second derivative of velocity with respect to time, and the third derivative of position with respect to time. Therefore, if acceleration can be measured for calculating the force on a body of known mass, then jerk can be measured for calculating the rate of change of the force on a body of known mass. As will be discussed in more detail infra, because jerk may be representative of a change in force, which may indicative of the sudden onset of an injury, the detection of jerk may serve as a good characteristic to monitor for causing the system or apparatus to operate in a safety mode.

As used herein, the term "displacement resistance" is the resistance of a physical object from being physically moved out of a position. For example, an object of a certain mass that is resting on a floor requires a certain amount of force to displace the object, e.g. to lift the object off of the floor. The displacement resistance of an object may also be different depending on the direction which a force is applied. For example, if the object resting on the floor has a weight of 100 pounds then the displacement resistance in the positive vertical direction, i.e. the direction directly opposite the gravitational force, is slightly greater than 100 pounds such that the sum of forces is greater than zero. Moreover, as used herein, the "displacement resistance" of an object can be either "actively" or "passively" modified. The combination of terms "actively modifying a displacement resistance" is intended to describe the modification of a displacement resistance through the active exertion of a force upon an object such as, for example, through the use of a fluid cylinder to transfer force through a cable to a barbell. The combination of terms "passively modifying a displacement resistance" is intended to describe the modification of a displacement resistance through altering the mechanical configuration of a device. Changing an amount of weight secured on a barbell, or a number of elastic bands attached to an exercise handle, or a number of bow limbs attached to an exercise handle, or changing a level of pressure to be applied at a generally unvarying level throughout an exercise are all examples of passively modifying a displacement resistance of an object.

As used herein, the term "demand" as in demand for a level of user input force is the level of user input force required to cause a particular movement of a user-input element, wherein the particular movement possesses at least the characteristics of direction of motion and acceleration. For example, a specific demand for a level of user input force is required to perform the concentric contraction portion of an elbow flexion exercise, e.g. an upright standard bicep curl of a standard dumbbell. In the upright standard bicep curl example, the level of user input force demanded for the concentric contraction is greater than the level of user input force demanded for the eccentric contraction because in order to perform the concentric contraction the user's muscle is required to overcome the weight of the dumbbell, i.e. lift the dumbbell. On the other hand, in order to perform the eccentric contraction the user's muscle is generally required only to generate a force great enough to lower the dumbbell in a controlled manner. Moreover, the level of user input force demanded for performing an exercise at different speeds varies accordingly. For example, a higher level of user input force will be demanded to perform a concentric bicep curl at a high speed than at a slow speed, assuming of course the weight is constant.

As shown in FIG. 1, an exercise system 10 for optimizing an exercise routine comprises a user-input element 12, a force-generating element 14, and a coupling means 16 for transferring forces between the user-input element 12 and the force-generating element 14. The user-input element 12 is intended to be forcibly moved by a user during a course of performance of an exercise, e.g. the user-input element 12 may be in the form of a simple handle as shown in FIG. 1 and a user may simply grasp the handle while performing an elbow flexion exercise such as, for example, bicep curls. The force-generating element 14 has the functional purpose of actively generating varying levels of force during the course of performance of an exercise during which these forces are transferred to the user-input element 12 via the coupling means 16 such that a user experiences the generated forces. For example, if a user is grasping the user-input element 12 then any forces generated by the force-generating element 14 will be felt by the user because the level of user input force required to cause a particular movement of the user-input element will be modified as the level of generated force varies. The exercise system 10 further comprises a control unit 18 which is in some, but not all, embodiments in communication with a user interface 20. Due to the aforementioned benefits of varying the effective muscle tension during the course of performance of an exercise, the control unit 18 is preferably configured to perform the operation of varying the level of generated force during the course of performance of an exercise by a user.

A typical reason to perform the operation of varying the level of generated force during the course of performance of an exercise by a user is to enable a user to perform an exercise during which the demand for force from the user is greater during the eccentric contractions than during the concentric contractions, or vice versa. During a concentric contraction the force generated by the muscle is sufficient to overcome the external load on the muscle and resultantly the muscle fibers shorten, whereas during an eccentric contraction the force generated by the muscle is insufficient to overcome the external load on the muscle and resultantly the muscle fibers lengthen. Therefore, generally when an environmental condition, e.g. the weight of a dumbbell, remains unchanged during an exercise, a user is unable to emphasize the eccentric portion of an exercise, i.e. perform the eccentric exercise at an intensity level at or near the maximum force a user is capable of for eccentric motions, because the user will likely be unable to increase the user input force for performing the concentric portion. However, if the force-generating element varies the level of generated force in such a way that the demand for performing the eccentric portion of an exercise is greater than the demand for performing the concentric portion of an exercise then a user will be able to emphasize the eccentric portion. This is because during eccentric training muscles can produce greater forces owing to the development of passive tension (due to the elastic proteins within muscle) and potentially the decreased rate of cross-bridge muscle detachments. Thus, in some embodiments, the exercise system 10 enables a user to shift the optimum length of peak muscle tension, i.e. the length at which a muscle is capable of producing the highest level of tension, such that the optimum length is increased.

In some embodiments, the force-generating element 14 comprises a fluid cylinder such as, for example, a hydraulic cylinder or a pneumatic cylinder. Preferably the force-generating element 14 supplies a generally constant force regardless of any user input. For example, if at a given stage of an exercise the control unit 18 is programmed to cause the force-generating element to generate a specific level of force, then preferably the level of force remains constant regardless of the level of user input force exerted upon the user-input element 12 or the speed at which a user moves the user-input element 12. To better describe this, some existing exercise machines utilize a constant flow valve to control the rate at which a fluid is able to work upon a piston such that varying user input forces have no effect on the speed at which the exercise is performed because, rather than increasing in speed, the piston simply supplies more resistive force against the user. While such a design characteristic may have benefits in some situations, isokinetic exercises are not desirable in all situations and accordingly this application discloses a system which may be used to perform isokinetic exercises but is not limited to doing so. Additionally, it is preferable to minimize resistive forces within the force-generating element 14, and for that matter within the coupling means 16 as well, which are proportional to the velocity at which the user-input element 12 is moved. These characteristics are desirable in order to create a natural feeling exercise, e.g. an exercise wherein the user-input element 12 responds similar to how a free and unconstrained object would respond to the same user-input forces. Therefore, it is preferable that the force-generating element 14 comprises a pneumatic cylinder. Due to the compressibility of air, some embodiments include a pressure reservoir such that any change in volume of the compressed fluid air has a practically negligible effect on the level of pressure exerted on the pneumatic cylinder piston 22.

Figure 2:
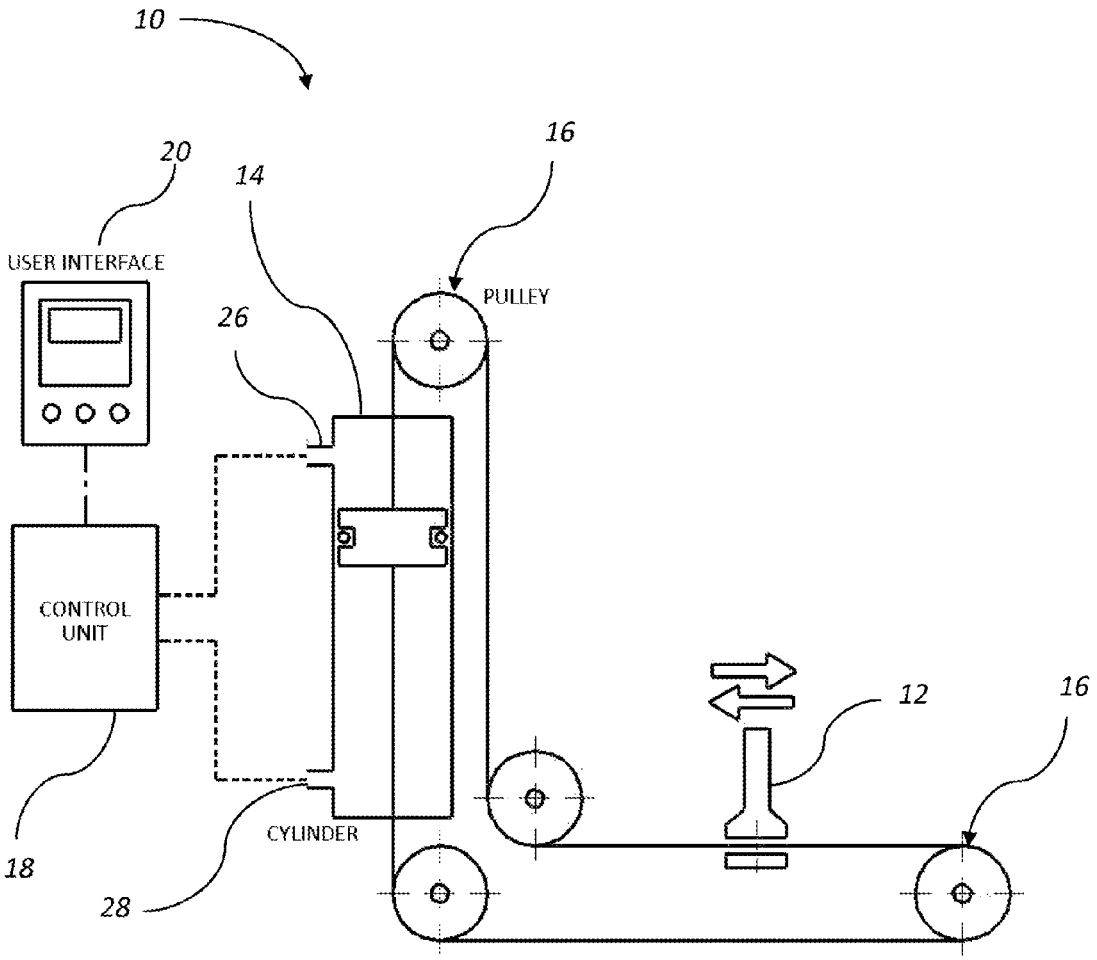
FIG. 2 shows a system diagram of the exercise system for shifting an optimum length of peak muscle tension in accordance with a second embodiment of the present disclosure.

While in some embodiments, the force-generating element 14 is a standard rod and piston type fluid cylinder, the force-generating element 14 is preferably a pneumatic rodless actuator, otherwise known as a cable cylinder. Pneumatic cable cylinders are preferable because they allow for a smooth and constant force to be generated and also require less space within the system 10 than a standard rod and piston type fluid cylinder does. A preferred embodiment comprises a cable cylinder with an effective diameter, i.e. the diameter of the piston, of 2.26 inches such that the effective area is approximately 4.0 square inches ($in^2$). Therefore, at the easily achievable pressure of 100 pounds per square inch (psi) the cylinder will generate the ample force of 400 lb. Referring particularly to FIGS. 1-2, in some embodiments the force-generating element 14 is a double acting cable cylinder. In these embodiments, the cable of the cable cylinder may be mechanically coupled to a cable of the means for 16 transferring forces. The example of fluid cylinders set forth herein are representative of merely certain embodiments of the system 10 and are not intended to be limiting. As such other components capable of producing a generally controlled level of varying forces may also be used. In some embodiments, the force-generating element 14 is torque motor connected to one of the pulleys to cause it to rotate in a selected direction. In these embodiments, a "belt" rather than a cable is used to transmit the force generated in the belt to the user input element 12. For example, a motor with 100 lb.-ft. torque capacity can generate a 400 lb. force if a 6-inch diameter pulley is used. This force will be able to counter balance a 400 lb. free weights and a barbell.

In some embodiments, the user-input element 12 comprises a handle attached to a cable-pulley system wherein the cable-pulley system is the coupling means 16. Because exercise systems utilizing cable-pulley systems attached to handles for movement by a user are well known in the art a high level of detail in this regard is unnecessary. However, as can be seen by referencing FIGS. 1 and 2, the handle may be configured for vertical movement, horizontal movement, or both. In some embodiments, the user-input element 12 is adjustable such that a user may vertically adjust the position of the user-input element 12, horizontally adjust the position of the user-input element 12, of both. An example of a vertically adjustable pulley system is disclosed in U.S. Pat. No. 6,527,683 B2 to Tolles, entitled Dual Adjustable Pulley Weight Apparatus, dated Mar. 4, 2003, and fully incorporated by reference herein. To provide a highly versatile system capable of accommodating a wide range of exercises, a preferred embodiment of the exercise system 10 comprises this or a similar system for adjusting the position of the user-input element 12.

Figure 3:
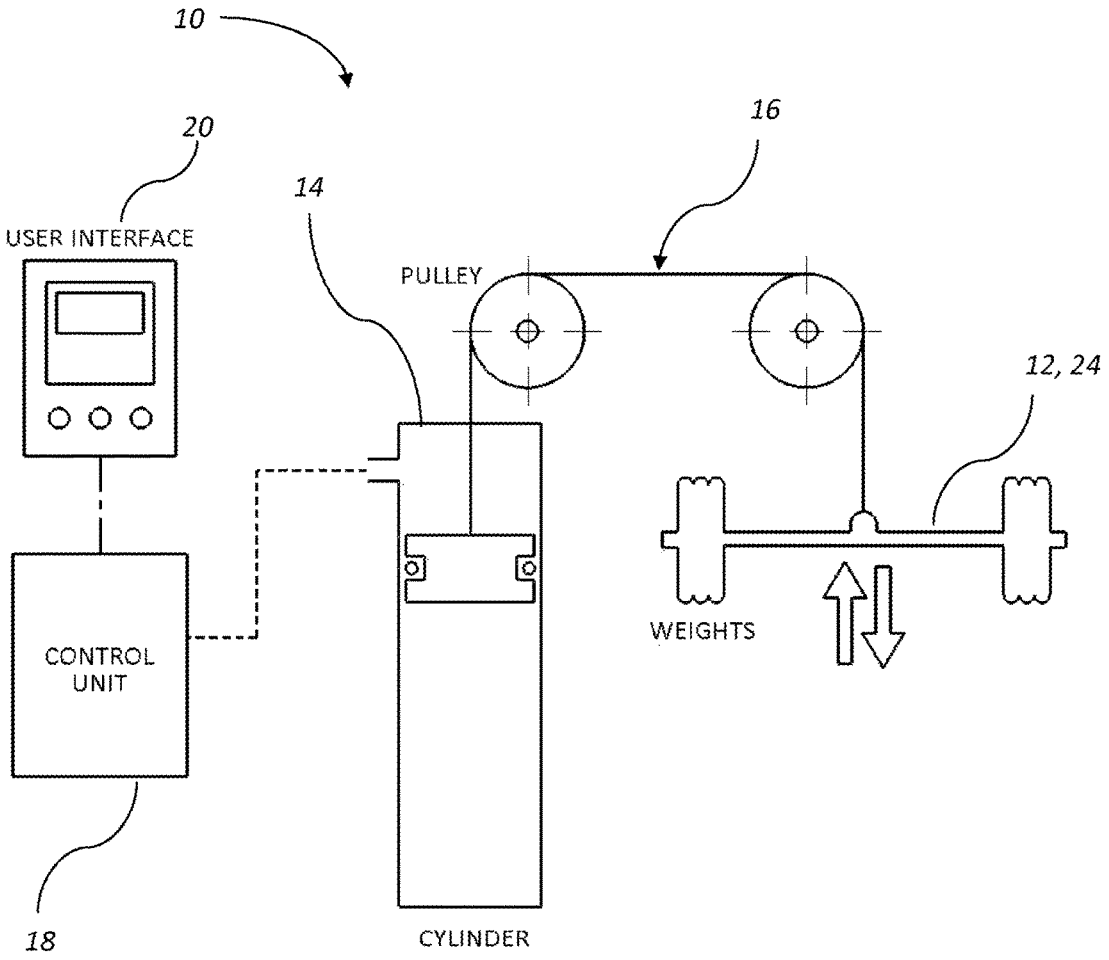
FIG. 3 shows a system diagram of the exercise system for shifting an optimum length of peak muscle tension in accordance with a third embodiment of the present disclosure.
Figure 4:
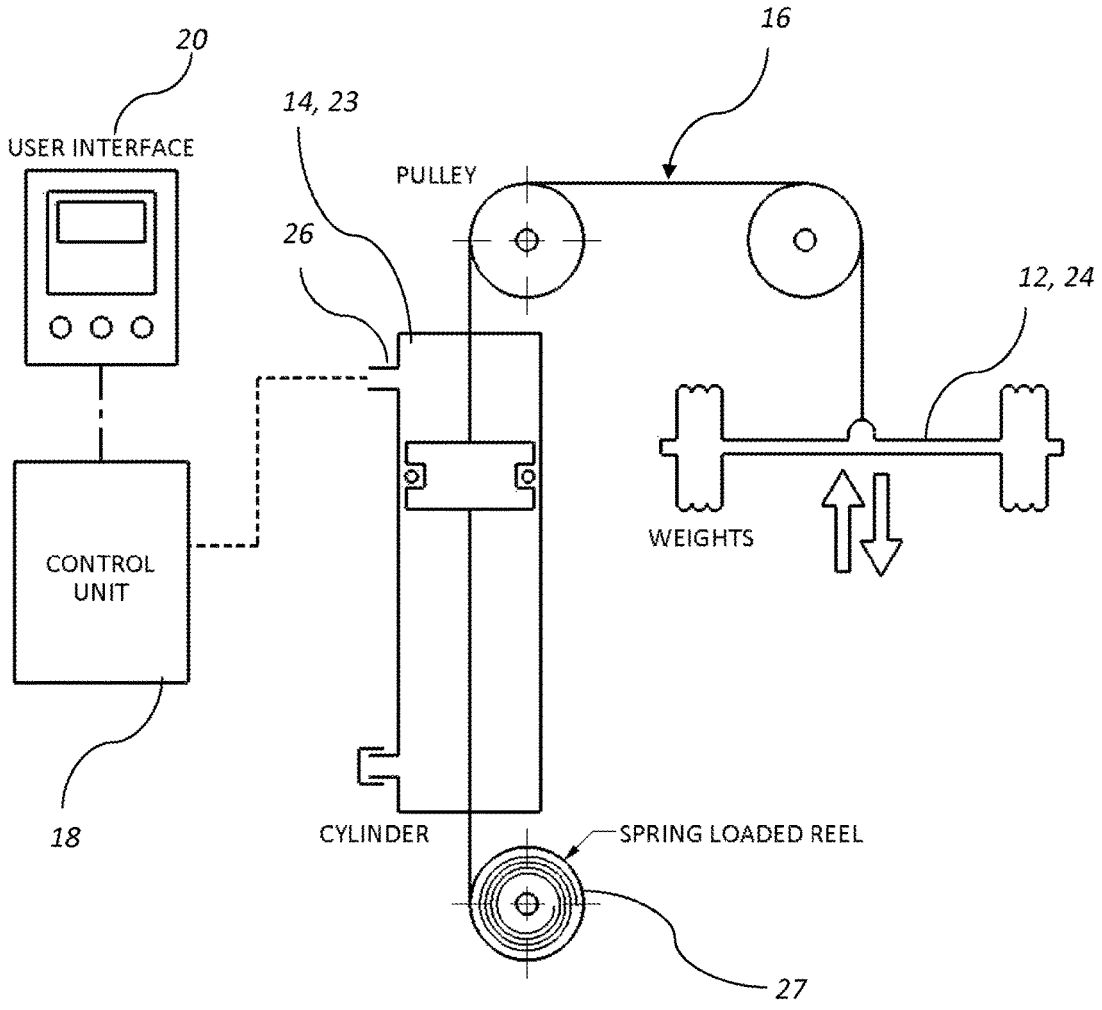
FIG. 4 shows a system diagram of the exercise system for shifting an optimum length of peak muscle tension in accordance with a fourth embodiment of the present disclosure.

Referring particularly to FIGS. 3-4, in other embodiments of the system 10, the user-input element 12 comprises a standard barbell 24. Embodiments wherein the user-input element 12 is a standard barbell 24 are preferable for certain types of common heavy lifting exercises which athletes are already accustomed to. For example, many athletes regularly perform both squats and deadlifts utilizing a barbell loaded with an appropriate amount of weight. The use of "free weights" is preferable by many athletes because of the natural and comfortable feel of using free weights as opposed to machine exercises where the path of movement is generally constrained. Additionally, the use of free weights is believed by many to stimulate stabilizing muscles more so than the use of exercise machines. In some embodiments, the coupling means 16 attaches to the barbell 24 at a single point or at a plurality of points. For example, the coupling means 16 may attach to the barbell at a center of mass or near the weights to balance the barbell when not being used. An embodiment wherein the coupling means 16 attaches at a single point may function quite well for some exercises, such as squats wherein a cable can apply a vertical force to the barbell at the center of mass without disrupting the user. Other exercises would be unsuitable for such an embodiment. While performing a deadlift, for example, a user must typically lean over the center of mass of a barbell and therefore the cable attachment should not interfere with the posture of the user. Thus, the coupling means 16 may attach to the user-input element 12 one or more points depending on the intended exercise to be performed.

In preferred embodiments, the coupling means 16 for transferring forces between the force-generating element 14 and the user-input element 12 comprises a cable-pulley system as is commonly used is many types of exercise equipment. However, the coupling means 16 may be a pulley system generally utilizing belts, nylon straps, and equivalents thereof. In other embodiments, the coupling means 16 does not comprise a pulley system at all. For example, the coupling means 16 may simply comprise a cable suspended vertically from the force-generating element 14. More specifically, in some embodiments the force-generating element 14 comprises one or more double acting pneumatic cylinders affixed to a support structure (not shown) above the user-input element 12 and the coupling means 16 comprises cable extending from each pneumatic cylinder.

With particular reference to FIGS. 3-4, some embodiments of a system 20 comprise a means for passively modifying the displacement resistance of the user-input element 12. In the embodiment illustrated, a user may passively modify the displacement resistance of the user-input element by adding additional weight to the barbell 24. In some embodiments, the means for passively modifying the displacement resistance comprise a barbell as shown here wherein a user may simply modify the barbell weight. In some embodiments, the means for passively modifying the displacement resistance comprises one or more elastic bands that can be added and subtracted to optimize the correct level of displacement resistance. In some embodiments, the means for passively modifying the displacement resistance comprises one or more bow limbs which, similar to the elastic bands, may be attached or detached to optimize the level of displacement resistance. In some embodiments, the means for modifying the displacement resistance comprises a pressure reservoir held at generally constant pressure throughout the duration of the exercise and applied to a single side of a double acting cylinder and, in these embodiments, the displacement resistance (i.e. the summation of the active and passive components), is actively modified by applying a pressure to the other side of the cylinder during only a portion of the exercise.

With particular reference to FIG. 4, an embodiment which is re-configured from the embodiment of FIG. 1, the system 10 comprise a spring loaded reel 27 for taking up slack that may build in one or more cables of the system 10. For example, in the illustration shown the control unit 18 is utilizing only a single port 26 of a double acting pneumatic cylinder 23 which is the force-generating element 14.

Figure 5:
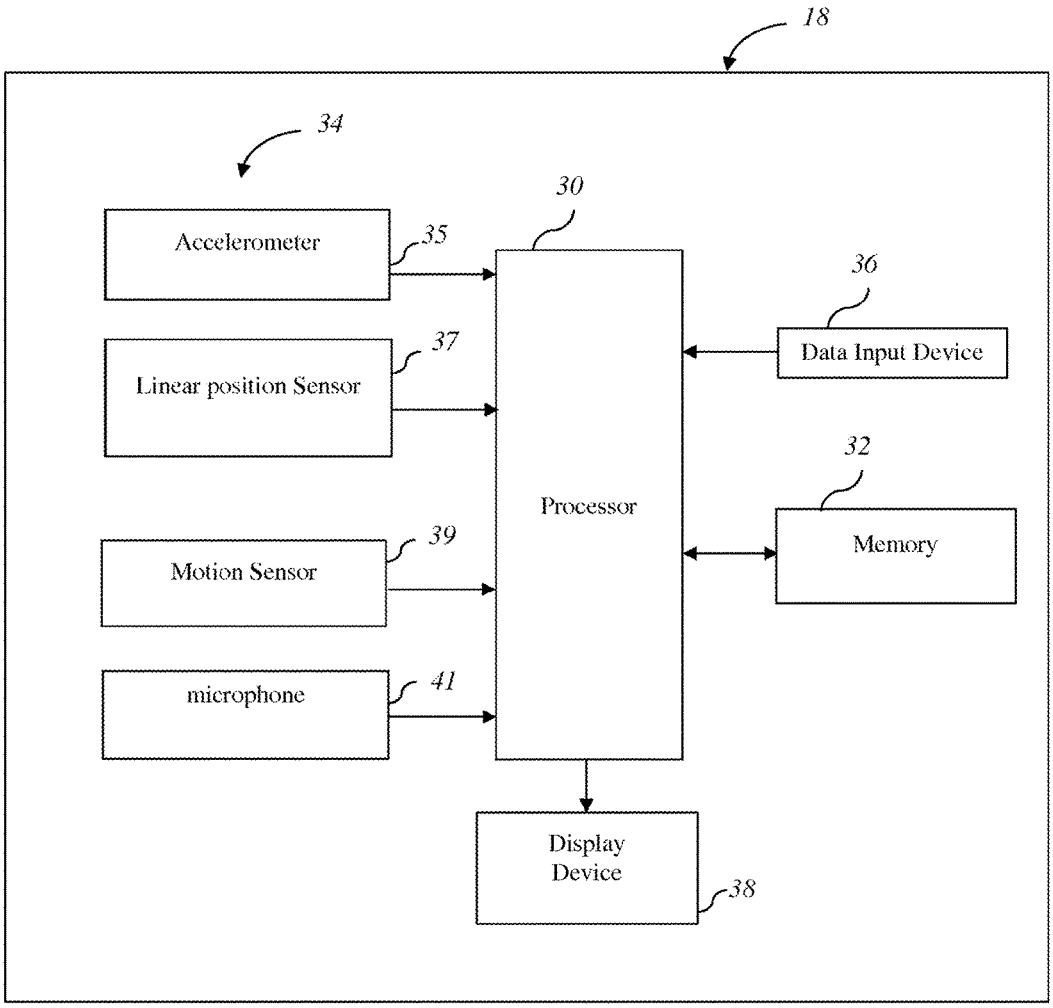
FIG. 5 shows a system diagram of a control unit of the exercise system for shifting an optimum length of peak muscle tension in accordance with various embodiments.

With particular reference to FIG. 5, a block diagram illustrates that the control unit 18 may include a processor 30, a memory 32, one or more sensors 34, a data input device 36, and a display device 38. The processor 30 is configured to communicate and cooperate with each of the memory 32, the data input device 36, the display device 38, and the sensor(s) 34, and also the display device 38. Systems controls are well known in the art and therefore specific details of the hardware are unnecessary.

In a preferred embodiment, the processor 30 is a microprocessor wherein the microprocessor comprises a built in non-volatile memory. The processor 16 may also have one or more communication ports for communicating with other elements of the system 10, with external devices such as a personal computer or a smartphone, or both. In a preferred embodiment, the memory 32 provides information to the processor 30 relating to the particular exercise being performed and the specific user performing the exercise, e.g. a user may input data into the system 10 regarding training goals, type of exercise desired to perform, and known weight capabilities for performing the exercise. Based on this information, the system 10 may then calculate an exercise routine and display information regarding the exercise on the display device 38.

In some embodiments, the memory 32 comprises one or more data storage devices such as semi-conductor memory, magnetic storage, and optical storage. For example, the memory may include a Secure Digital™ (SD) non-volatile memory card. In some embodiments, at least a part of the memory 32 is of an industrial standard format, non-volatile, and also removable, e.g., an SD card or a Universal Serial Bus (USB) flash drive, in order to ensure that the data associated with the system 10 is lasting and easily accessible. Other types of data storage devices known in the art may also be used.

In a preferred embodiment, the data input device 36 includes a plurality of push-buttons as the user interface elements. As used herein, the term data input device is to be defined broadly as any device that can be used to input data into a computer or other computational device, such as e.g. the control unit 18. Preferably, the data input device 20 comprises, in addition to a plurality of push-buttons or one or more touch screens, one or more additional communications ports. For example, the data input device 36 may include an industrial standard Universal Serial Bus (certified USB™) port, such as a Micro B USB plug, to connect the control unit 18 to a peripheral device such as a personal computer or smart phone to upload data associated with one or more particular system users.

In a preferred embodiment, the display device 38 is a liquid crystal display (LCD), and is also preferably positioned such that a user may see it during the performance of an exercise. Other display devices known in the art may be used.

The control unit 18 is preferably configured for causing the force-generating element to generate a level of generated force for actively modifying a displacement resistance of the user-input element and also varying the level of generated force during the course of performance of an exercise by a user. For example, the control unit 18 may cause the force-generating element 14 to generate no force whatever during the eccentric portion of an exercise such that the user must resist muscle elongation against the entire weight of a 200 pound barbell but then generate a level of force equal to 100 pounds during the concentric portion of the exercise such that a user is greatly assisted during the concentric contraction. In this example, the displacement resistance of barbell is actively modified only during the concentric portion of the exercise. The user may passively modify the displacement resistance of the barbell by varying its loaded weight.

In some embodiments, the control unit 18 comprises one or more pressure regulators which control one or more levels of pressure which are applied on a piston of a fluid cylinder, e.g. a pneumatic rodless actuator. One or more valves configured to selectively toggle between the level(s) of pressure may also be included. Preferably, the valves are configured to apply varying levels of pressure based upon one or more of the aforementioned factors, i.e. a position of the user-input element; a direction of motion of the user-input element; a velocity of the user-input element; an acceleration of the user-input element; a jerk of the user-input element; and a level of user-input force applied by a user upon the user-input element. For example, the valves of the control unit 18 may be configured to toggle between applying atmospheric pressure to the cylinder during the eccentric portion of the exercise and then toggle to level of 100 psi of pressure during the concentric portion of the exercise to thereby actively modify the displacement resistance of the user-input element 12 so as to assist the user during the concentric portion of the exercise. Referring particularly to FIGS. 1-2, in some embodiments the control unit 18 comprises a four-way valve configured for toggling between at least two levels of pressure being applied to a first port 26 and a second port 28.

Referring back to FIG. 5, the control unit 18 may also include one or more sensors 34. As will be discussed in more detail infra, various types of sensors such as accelerometers 35, linear position sensors 37, motion sensors 39, and microphones 41 may be used to measure various properties of the exercise system 10 or the user thereof.

Figure 6:
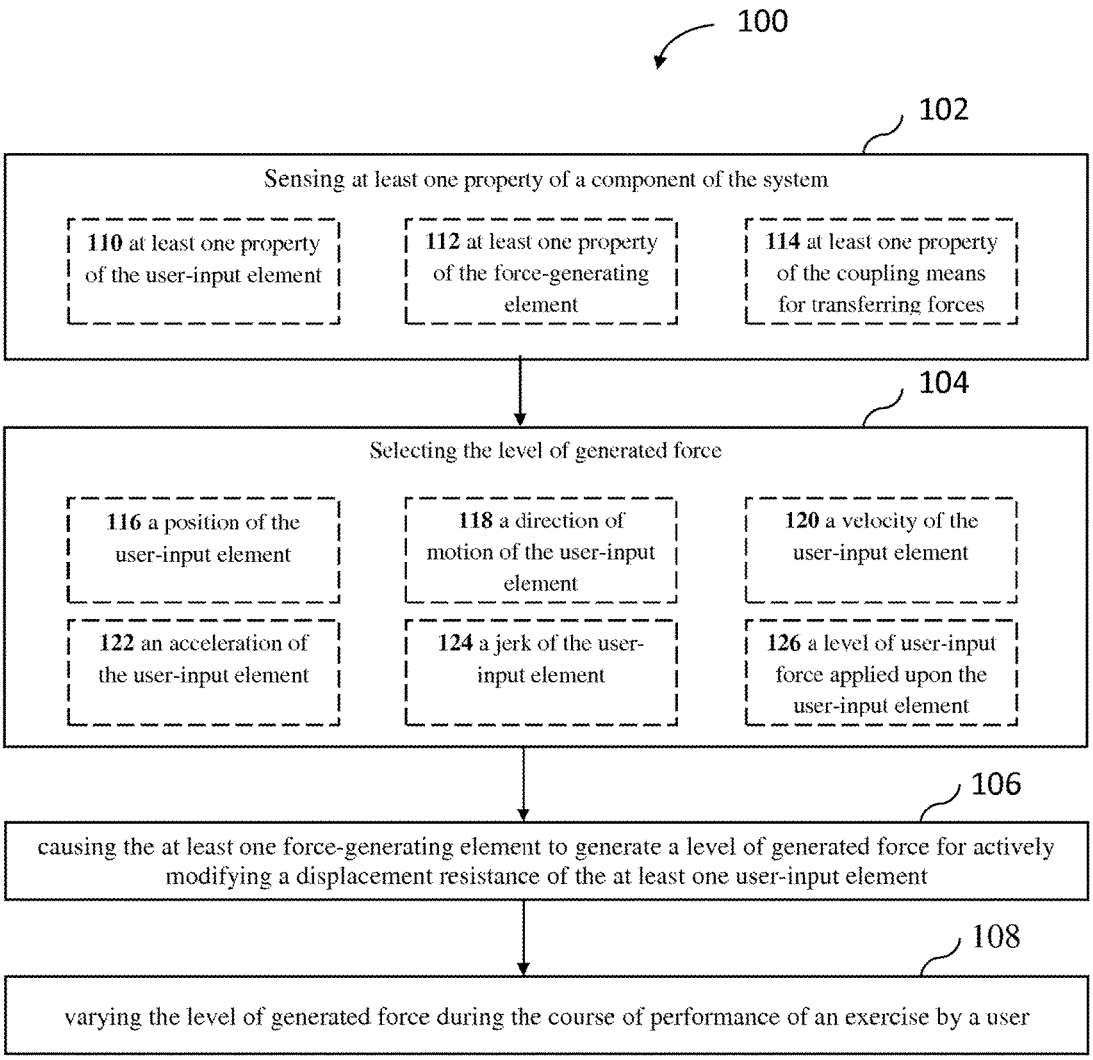
FIGS. 6-9 are block diagrams of various embodiments of the exercise systems of FIGS. 1-5 illustrating various operations which various embodiments may be configured for performing.

FIG. 6 illustrates a block diagram in accordance with an embodiment of the exercise system 100 disclosed herein, wherein the block diagram illustrates various operations certain embodiments may be configured to perform. In some embodiments, an exercise system 100, or the control unit thereof, may be configured to perform any of the operations of sensing at least one property of a component of the system 102, selecting the level of generated force 104, causing the at least one force-generating element to generate a level of generated force for actively modifying a displacement resistance of the at least one user-input element 106, and varying the level of generated force during the course of performance of an exercise by a user 108.

In some embodiments, the operation of sensing at least one property of a component of the system at block 102 may be performed by one or more different types of sensing device. For example, the operation of sensing at least one property of a component of the system at block 102 may be performed by an accelerometer integrated into the user-input element 12. Alternatively, the operation at block 102 may be performed by a linear position sensor configured to measure a position of a piston within the force-generating element 14. As illustrated in FIG. 6, the operation at block 102 may comprise sensing at least one property of the user-input element at block 110, sensing at least one property of the force-generating element at block 112, sensing at least one property of the coupling means for transferring forces at block 114, or any combination thereof. The operation of sensing at least one property of the user-input element at block 110 may be performed by an accelerometer integrated into the user-input element 12 such that the acceleration of the user-input element may be measured directly and the velocity and position of the user-input element may be calculated by the control unit 18 using various data points of acceleration over time. The operation of sensing at least one property of the force-generating element at block 112 may be performed by configuring a linear position sensor to measure the position of at least one component of the force-generating element 14, e.g. a piston within a fluid cylinder with reference to a static point on the cylinder housing. The operation of sensing at least one property of the coupling means for transferring forces at block 114 may be performed by configuring a rotary encoder, also referred to commonly as a shaft encoder, to measure the angular position of one or more pulleys within the coupling means 16, assuming of course the coupling means 16 comprises a pulley in that particular embodiment. It will be recognized by one in the art that the pertinent properties of the system, e.g. those discussed here, may be measured in many different ways using standard sensors widely available on the market.

In some embodiments, the operation of selecting the level of generated force at block 104 may be performed by the control unit 18 based upon one or more system properties previously sensed during the operation at block 102. For example, the control unit 18 may select a first level of force to generate when the user-input element is being raised and a second level of force to generate when the user-input element is being lowered. As illustrated in FIG. 6, the operation at block 104 may comprise selecting the level of generated force based on a position of the user-input element at block 116, a direction of motion of the user-input element at block 118, a velocity of the user-input element at block 120, an acceleration of the user-input element at block 122, a jerk of the user-input element at block 124, a level of user-input force applied upon the user-input element at block 126, or any combination thereof. The operation of selecting the level of generated force based on a position of the user-input element at block 116 may be performed by sensing a beginning position of an exercise, e.g. the standing with knees slightly bent position for an eccentric squat, and an ending position of the exercise, e.g. the position of the user-input element when the user reaches the full squat position, and generating a level of force to assist the user in performing the concentric contraction when the ending position is reached and removing the assistance when the beginning position is reached. The operation of selecting the level of generated force based on a direction of motion of the user-input element at block 118 may be performed by simply selecting a level of force to assist the user whenever the user-input element is moving in a first direction and selecting a second level of force whenever the user-input element is moving in a second direction. For clarity, it is within the meaning of selecting the level of generated force to select a force of zero such that the displacement resistance is not actively modified at some times during an exercise. The operations of selecting the level of generated force based on: a velocity of the user-input element at block 120; an acceleration of the user-input element at block 122; a jerk of the user-input element at block 124 may all be performed by integrating an accelerometer into user-input element. Selecting the level of force based on a jerk at block 124 is of particular importance because jerk may be representative of a change in force, which may indicative of the sudden onset of an injury, the detection of jerk may serve as a good characteristic to monitor for causing the system or apparatus to enter into a safety mode as will be discussed infra. For example, assuming the user is acting upon a standard barbell of constant mass and that the level of generated force remains unchanged then the level of force that the user exerts upon the user input element will determine the acceleration of barbell. If the user experiences a sudden injury, e.g. a muscle strain, cramp, or slight soft tissue tear, the user will most certainly respond by changing (consciously or reactionary) the level of force being applied. In some exercises this may be particularly dangerous. If a user experiences a muscle strain during an eccentric squat the user may be unable to continue to support the barbell whatsoever. This will result in a sudden change in force thereby resulting in a change in acceleration or jerk. Therefore, the operation at block 104 may select a level of force equal to or even greater than the weight of the barbell so as to alleviate the user from needing to apply any force at all.

In some embodiments, the operation of causing the at least one force-generating element to generate a level of generated force for actively modifying a displacement resistance of the at least one user-input element at block 106 may be performed by the control unit 18 based upon data from the operations at blocks 102 and 104. For example, the control unit may comprise a pressure reservoir and a valve and may cause a pneumatic cylinder to generate an assistance force thereby actively modifying the force a user must exert upon the user-input element to cause displacement thereof. In some embodiments, the operation of varying the level of generated force during the course of performance of an exercise by a user at block 108 may be performed by the control unit 18 similarly based upon data from the operations at blocks 102 and 104. For example, selecting a level of force equal to or even greater than the weight of the barbell in response to a sensed jerk would satisfy this operation as would simply varying the level of generated force based on whether the user is performing an eccentric, concentric, or isometric muscle contraction.

Figure 7:
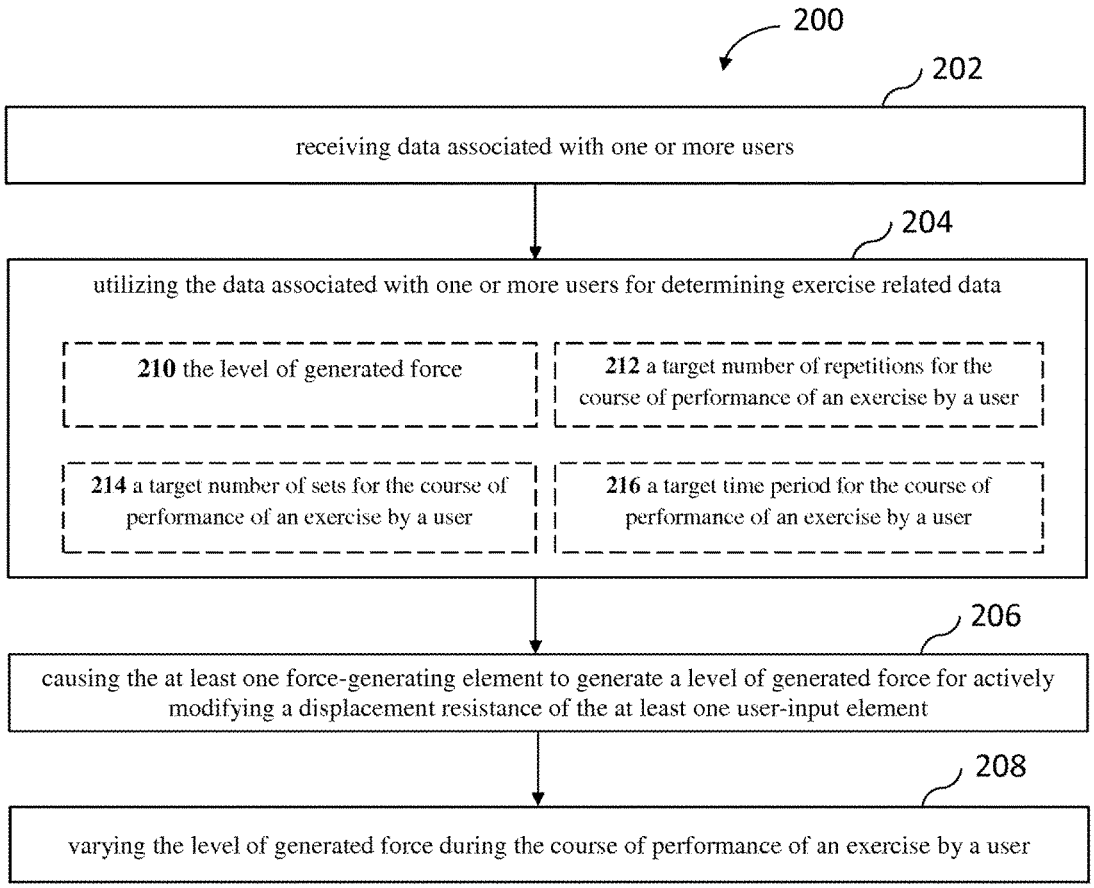

FIG. 7 illustrates a block diagram in accordance with an embodiment of the exercise system 200 disclosed herein, wherein the block diagram illustrates various operations certain embodiments may be configured to perform. In some embodiments, an exercise system 200, or the control unit thereof, may be configured to perform any of the operations of receiving data associated with one or more users 202, utilizing the data associated with one or more users for determining exercise related data 204, causing the at least one force-generating element to generate a level of generated force for actively modifying a displacement resistance of the at least one user-input element 206, and varying the level of generated force during the course of performance of an exercise by a user 208.

In some embodiments, the operation of receiving data associated with one or more users at block 202 may be performed by receiving user data via one or more different data input devices. As shown in FIG. 5 the control unit 18 may comprise a data input device 36. Specific details of types of data input devices are discussed in more detail supra. Regarding various types of data, the system may receive at block 202 data such as, for example, one or more: user names; passwords; previous performance data, e.g. type of exercise-weight-repetition information; baseline performance data at the beginning of a routine; and injury data. This data types listed are for illustrative purposes only and do not limit the scope of data that may be received, and, in fact, any type of data may be received for a multitude of reasons. Moreover, the system 202 may perform one or more other operations disclosed herein in order to gather user data. For example, in some embodiments the user may load a barbell of the system with a weight greater than that which a user is capable of lifting. The system may then generate a level of force equal to the weight of the barbell thereby enabling the user to move the barbell into a predetermined position. Once in the position, the system may then vary the level of generated force such that the level of force assisting the user in lifting the barbell is reduced until the user is no longer capable of maintaining the barbell in a static position by performing an isometric contraction. The system may then calculate the effective load which the user was capable of maintaining. The system will receive that data as the user's max isometric load capability at block 202. Preferably, the system 200 is configured to receive at least a user name, and data associated with that user's previous performances with the system 200.

In some embodiments, the operation of utilizing the data associated with one or more users for determining exercise related data at block 204 may be performed by the control unit 18 wherein the control unit 18 determines a suggested exercise routine for a user based upon user data received at block 202. As illustrated in FIG. 7, the operation at block 204 may comprise utilizing the data received at block 202 for determining the level of generated force at block 210, a target number of repetitions for the course of performance of an exercise by a user at block 212, a target number of sets for the course of performance of an exercise by a user at block 214, a target time period for the course of performance of an exercise by a user at block 216, or any combination thereof. The operation of utilizing the data received at block 202 for determining the level of generated force at block 210 may comprise utilizing data regarding a known level of force generated during a previous exercise session for a specific user and determining that the generated level of force will be lowered during the current exercise session to account for probable strength gains of the user. For example, if the user is going to perform a squat exercise with a standard barbell loaded with the same amount of weight as a previous exercise and an acceptable recovery period has elapsed, the system may determine to generate a lower level of force, wherein the generated force assists the user, during the concentric portion of the exercise. The operation of utilizing the data received at block 202 for determining a target number of repetitions for the course of performance of an exercise by a user at block 212 may be performed similarly to the last mentioned example except that instead of lowering the level of generated force the system may determine that the user should attempt to perform additional repetitions as compared to the previous session. The system would indicate to the user via a user interface the target number determined at block 212. One skilled in the art will recognize numerous benefits of performing the additional operations of utilizing the data received at block 202 for determining a target number of sets for the course of performance of an exercise by a user at block 214 and for determining a target time period for the course of performance of an exercise by a user at block 216. As with all examples provided herein, these embodiments and descriptions are for illustrative purposes only and are not intended to limit the scope of the present disclosure.

Still referring to FIG. 7, the operations of causing the at least one force-generating element to generate a level of generated force for actively modifying a displacement resistance of the at least one user-input element at block 206, and varying the level of generated force during the course of performance of an exercise by a user at block 208 are discussed in detail supra and, in order to reduce redundancy, need not be discussed again.

Figure 8:
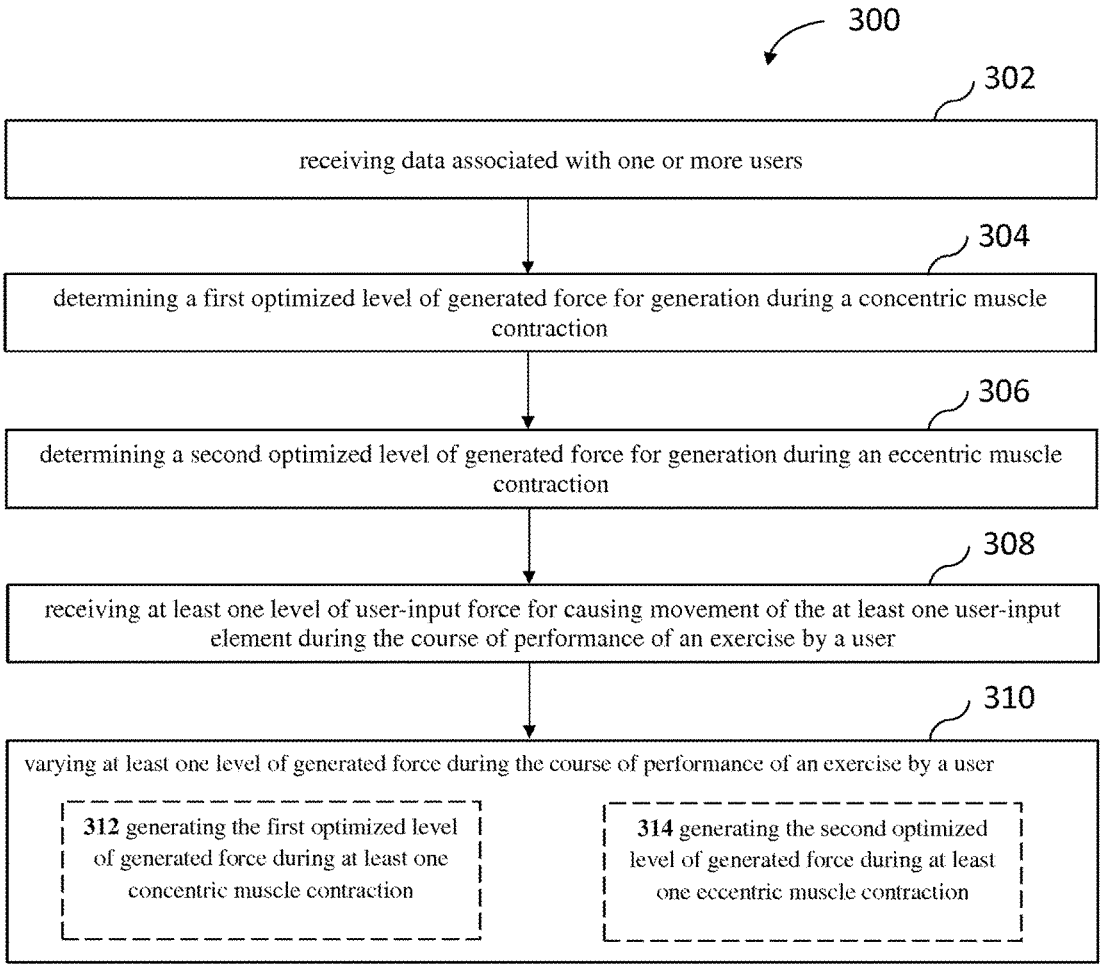

Referring now to FIG. 8, a block diagram in accordance with an embodiment of the exercise system 300 disclosed herein is shown, wherein the block diagram illustrates various operations certain embodiments may be configured to perform. In some embodiments, an exercise system 300, or the control unit thereof, may be configured to perform any of the operations of receiving data associated with one or more users 302, determining a first optimized level of generated force for generation during a concentric muscle contraction 304, determining a second optimized level of generated force for generation during an eccentric muscle contraction 306, receiving at least one level of user-input force for causing movement of the at least one user-input element during the course of performance of an exercise by a user 308, varying at least one level of generated force during the course of performance of an exercise by a user 310. In such embodiments, the operation at block 310 preferably comprises the operations of generating the first optimized level of generated force during at least one concentric muscle contraction at block 312 and generating the second optimized level of generated force during at least one eccentric muscle contraction at block 314. It is within the scope of the exercise system 300 for the first optimized level of force to be either greater than or less than the second optimized level of force.

Generally, but not in all embodiments, the level of generated force, which actively modifies the displacement resistance, is generated to assist the user in performing one either the eccentric or concentric contraction portion of an exercise. For example, the control unit 18 may cause the force-generating element 14 to generate no force whatever during the eccentric portion of an exercise such that the user must resist muscle elongation against the entire weight of a 200 pound barbell but then a level of force equal to 100 pounds during the concentric portion of the exercise such that a user is greatly assisted during the concentric contraction. In this example, the displacement resistance of barbell is actively modified only during the concentric portion of the exercise, i.e. the first optimized level of force is 100 pounds and the second optimized level of force is 0 pounds. The user may passively modify the displacement resistance of the barbell by varying its loaded weight. In this example, the operation of receiving at least one level of user-input force for causing movement of the at least one user-input element during the course of performance of an exercise by a user at block 308 is performed throughout the exercise with the system 300, and more particularly the user-input element which is the barbell of this example, receiving a level of user-input force of slightly less than 200 pounds during the eccentric portion and slightly more than 100 pounds during the concentric portion.

Figure 9:
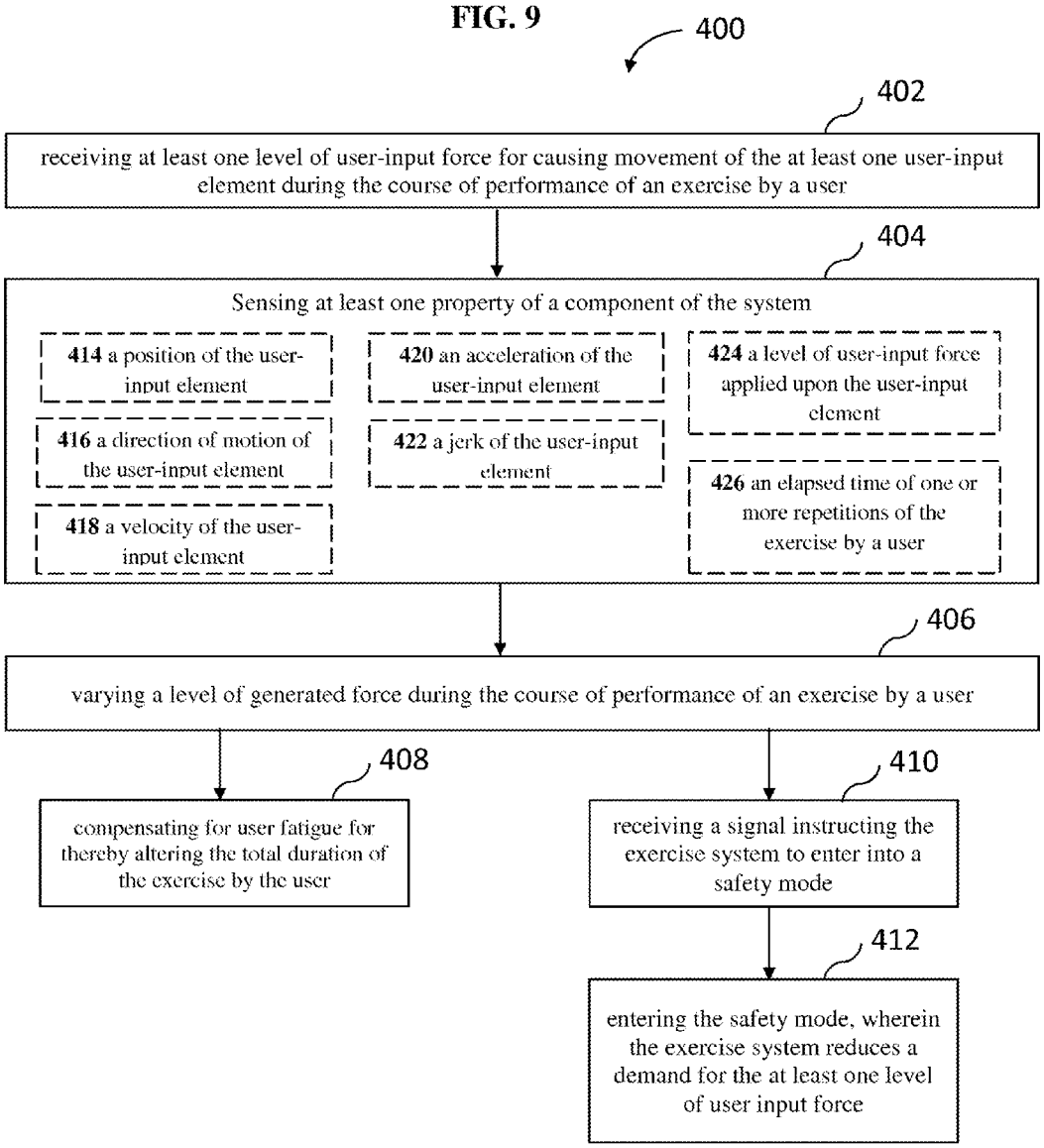

Referring now to FIG. 9, a block diagram in accordance with an embodiment of the exercise system 400 disclosed herein is shown, wherein the block diagram illustrates various operations certain embodiments may be configured to perform. In some embodiments, an exercise system 400, or the control unit thereof, may be configured to perform any of the operations of receiving at least one level of user-input force for causing movement of the at least one user-input element during the course of performance of an exercise by a user 402, sensing at least one property of a component of the system 404, varying a level of generated force during the course of performance of an exercise by a user 406, compensating for user fatigue for thereby altering the total duration of the exercise by the user 408, receiving a signal instructing the exercise system to enter into a safety mode 410, entering the safety mode, wherein the exercise system reduces a demand for the at least one level of user input force 412, or any combination thereof. Still referring to FIG. 7, the operations at blocks 402, 404, and 406 are discussed in detail supra and, in order to reduce redundancy, need not be discussed again.

In some embodiments, the operation of compensating for user fatigue for thereby altering the total duration of the exercise by the user at block 408 may be performed by increasing the level of generated force gradually over the course of the exercise. This is, of course, assuming that in the particular embodiment increasing the level of generated force decreases the displacement resistance of the user-input element thereby making the performance of exercise movements easier. This is of particular benefit to users who wish to perform "burn-out" type exercises where the user begins with a relatively large amount of weight and performs the exercise until the user cannot perform another repetition with that weight. At this point the user may lower the weight and again perform the exercise until the user cannot perform another repetition with the lowered weight. The user may repeat this pattern until the user cannot perform the exercise even with close to no weight at all. The operation at block 408 allows the user to receive the benefit of performing "burn-out" exercises without having to manually alter the weight, i.e. the user need not passively modify the displacement resistance. For example, suppose a user wishes to perform a burn-out, utilizing the operation at block 408, with the exercise being a simple concentration bicep curl. The user may begin the exercise with a loaded barbell weighing 80 lbs. and may perform the exercise a number of times until the system 400 begins to compensate for the user's fatigue. The system may sense, for example, an elapsed time of one or more repetitions of the exercise by a user at block 426 and infer based on the user taking too long per repletion that the user is fatigued. In order to compensate for user fatigue the system may perform the operation at block 406 by generating a level of generated force of 10 lbs. Once the user is unable to perform a repetition with the 10 lbs. of assistance, i.e. with an effective weight of 70 lbs., within a predetermined amount of time per repetition the system 400 may then repeat the operations at blocks 408 and 406 to increase the level of generated force to further assist the user in the continued performance of the exercise notwithstanding the user's increased level of fatigue. Preferably, system 400 is configured with at least one preset burnout routine wherein a user need only entering the amount of starting weight and the operation of compensating for user fatigue for thereby altering the total duration of the exercise by the user at block 408 will automatically add assistance as a percentage of total weight, e.g. 10% of total weight, each time the system 400 performs operation 408. The system 400 is also preferably fully programmable such that a user can create custom exercise routines and save the routines in the system's memory 32 for continued use. Moreover, in some embodiments, the operation of compensating for user fatigue for thereby altering the total duration of the exercise by the user at block 408 may be performed by decreasing the level of generated force over the course of the exercise if it is determined that the user is not fatiguing quickly enough. Therefore, the system may also be configured to increase the level of intensity of an exercise to ensure the user is receiving a meaningful workout.

In a preferred embodiment, the system 400 is configured to perform the operations of receiving a signal instructing the exercise system to enter into a safety mode at block 410, and entering the safety mode, wherein the exercise system reduces a demand for the at least one level of user input force at block 412. As explained supra, muscles are capable of performing eccentric exercises against greater resistance than concentric exercises and it is an intended purpose of the systems disclosed herein to benefit from this fact. However, because the user will often be using greater weight than the user is capable of performing one or more exercise movements against in the absence of assistance, the system preferably comprises a safety mode wherein the exercise system 400 quickly reduces the demand for user-input force. For example, suppose a user is performing an eccentric squat exercise and at a point near the bottom of the motion the user experiences a sharp pain severe enough that the user is either already injured or at great risk of injury if the exercise is continued. Further suppose that nothing that the system has sensed at block 404 would trigger any assistance or that even that if such assistance were provided the level of assistance would not be great enough for the user to support the weight. Without a safety mode the user may be in great risk of injury. Therefore, the operation of sensing at least one property of a component of the system at block 404 may also serve to signal the system at block 410. For example, a predetermined level of jerk sensed at block 422 may signal the system to enter the safety mode. Moreover, other types of signals may also be received including but not limited to audible signals. For example, a user may recite the command "enter safety mode" as the signal or the signal may simply be any sound within a range of pitches and above a certain decibel level. A user's reaction to the pain of yelling or yelping may also serve as the signal at block 410. Preferably, the operation at block 412 reduces the demand for user input load completely, i.e. the system 400 may lock the user-input element with an integrated brake system. For example, a mechanism similar to a fall arrester may respond to a level of velocity of the user-input element by locking the user-input element in place. Alternatively, the system 400 may alter the level of generated force to approximately balance the user-input element altogether.

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

The invention claimed is:

1. An exercise system comprising:
a pneumatic cylinder having a piston movably disposed therein and a port;
one or more coupling elements having a portion that is coupled to the piston;
one or more user-input elements that are coupled to a portion of the one or more coupling elements;
one or more valves configured control air pressure delivered to the port; and
one or more electronic control units that are configured to perform operations including at least:
provide an initial pressure level corresponding to one or more levels of displacement resistance of the one or more user-input elements; and
adjust pressure away from the initial pressure level in successive increments over a course of an exercise to gradually change the one or more levels of displacement resistance of the one or more user-input elements in response to each instance where one or more repetitions cannot be performed within a specified time.

2. An exercise system comprising:
a pneumatic cylinder configured to generate one or more levels of displacement resistance force, the pneumatic cylinder including at least:
a housing;
a piston movably disposed within the housing; and
at least one port;
a user-input element; and
a coupling element that links the user-input element with the piston of the pneumatic cylinder; and
an electronic control unit including at least:
a computer readable memory;
a processor; and
one or more instructions stored on the computer readable memory that are configured to instruct the processor to perform operations including at least:
provide an initial pressure level to the at least one port of the pneumatic cylinder to provide an initial level of resistance force for an exercise; and
adjusting pressure away from the initial pressure level in successive increments over a course of the exercise to gradually change one or more levels of resistance force in response to each instance where one or more repetitions cannot be performed within a specified time.

3. An exercise system comprising:
one or more pneumatic cylinders configured to generate one or more levels of resistance force;
one or more user-input elements;
one or more coupling elements that couple the one or more pneumatic cylinders to the one or more user-input elements; and
one or more electronic control units configured to at least:
provide an initial level of resistance force for an exercise; and
adjust resistance force away from the initial level of resistance force in successive increments during a course of the exercise to provide one or more gradually changing levels of resistance force in response to each instance where one or more repetitions cannot be performed within a specified time.

4. The exercise system of claim 1, wherein the one or more user-input elements comprises:
at least one of a handle or a barbell.

5. The exercise system of claim 1, wherein the one or more coupling elements comprises:

at least one cable; and at least one pulley.

6. The exercise system of claim 1, wherein the one or more electronic control units is configured to adjust resistance force in response to one or more of the following parameters:

a velocity of the one or more user-input elements;

an acceleration of the one or more user-input elements; or a level of force applied upon the one or more user-input elements.

7. The exercise system of claim 1, further comprising:

at least one sensor, in communication with the one or more electronic control units, configured for sensing at least one property of:

the one or more user-input elements;

the one or more pneumatic cylinders; or the one or more coupling elements.

8. The exercise system of claim 1, wherein the one or more electronic control units is further configured to:

receive data associated with one or more users; and utilize the data associated with one or more users for determining at least one of:

a level of resistance force;

a target time period for performance of the exercise;

a target number of repetitions of the exercise; or a target number of sets of the exercise.

9. The exercise system of claim 1, further comprising:

one or more graphical user interfaces.

10. The exercise system of claim 1, further comprising:

one or more mechanical configurations for passively modifying resistance force.

11. The exercise system of claim 1, wherein the one or more electronic control units is further configured to:

receive data associated with one or more users;

determine a first level of resistance force for generation during a concentric phase of the exercise; and determining a second different level of resistance force for generation during an eccentric phase of the exercise.

12. The exercise system of claim 1, wherein the one or more electronic control units is further configured to:

receive one or more signals to enter into a safety mode; and enter the safety mode including at least one of reducing resistance force or locking the one or more user-input elements in place.

13. The exercise system of claim 3, wherein the one or more electronic control units are configured to perform an operation comprising:

adjust resistance force away from the initial level of resistance force in successive increments during a course of the exercise to provide one or more gradually increasing or decreasing levels of resistance force in response to each instance where one or more repetitions cannot be performed within a specified time.

14. The exercise system of claim 3, wherein the one or more electronic control units are configured to perform an operation comprising:

adjust resistance force away from the initial level of resistance force in successive increments during a course of the exercise to provide one or more gradually changing levels of dynamic resistance force in response to each instance where one or more repetitions cannot be performed within a specified time.

15. The exercise system of claim 1, wherein the one or more electronic control units are configured to perform an operation comprising:

adjust resistance force away from the initial level of resistance force in successive increments during a course of the exercise to progressively make one or more subsequent repetitions less challenging than one or more previous repetitions.

16. The exercise system of claim 3, wherein the one or more electronic control units are configured to perform an operation comprising:

adjust resistance force away from the initial level of resistance force to an ending level of resistance force in successive increments during a course of the exercise to provide one or more gradually changing levels of resistance force in response to each instance where one or more repetitions cannot be performed within a specified time.

17. The exercise system of claim 1, wherein the one or more electronic control units are configured to perform an operation comprising:

adjust pressure away from the initial pressure level in successive increments over a course of an exercise to gradually change the one or more levels of dynamic resistance of the one or more user-input elements in response to each instance where one or more repetitions cannot be performed within a specified time.

18. The exercise system of claim 2, wherein the one or more instructions are configured to instruct the processor to perform an operation comprising:

adjusting pressure away from the initial pressure level in successive increments over a course of the exercise to gradually change one or more levels of dynamic force in response to each instance where one or more repetitions cannot be performed within a specified time.

19. An exercise system comprising:

a pneumatic cylinder having a piston movably disposed therein and a port;

one or more coupling elements having a portion that is coupled to the piston;

one or more user-input elements that are coupled to a portion of the one or more coupling elements;

one or more valves configured control air pressure delivered to the port; and one or more electronic control units that are configured to perform operations including at least:

provide an initial pressure level corresponding to one or more levels of displacement resistance of the one or more user-input elements; and adjust pressure away from the initial pressure level in successive increments over a course of an exercise to gradually change the one or more levels of displacement resistance of the one or more user-input elements until one or more repetitions cannot be performed within a specified time.

20. The exercise system of claim 19, wherein the one or more electronic control units are configured to perform an operation comprising:

adjust pressure away from the initial pressure level in successive increments over a course of an exercise to gradually change the one or more levels of dynamic resistance of the one or more user-input elements until one or more repetitions cannot be performed within a specified time.

* * * * *